US005353814A

United States Patent [19]

Martin

[11] Patent Number: 5,353,814

[45] Date of Patent: Oct. 11, 1994

[54] CIGARETTE SMOKE CLEANSING SMOKING DEVICE

[76] Inventor: Mark J. Martin, 2713 E. 4th Ave., Spokane, Wash. 99202

[21] Appl. No.: 37,308

[22] Filed: Mar. 26, 1993

[51] Int. Cl.[5] ..... A24F 13/06

[52] U.S. Cl. ..... 131/215.2; 131/175

[58] Field of Search ..... 131/174, 175, 215.1, 131/215.2, 215.3, 330, 270, 271

[56] References Cited

U.S. PATENT DOCUMENTS

| | | | |
|---|---|---|---|
| 1,833,931 | 12/1931 | Bryant | 131/175 |
| 2,132,909 | 10/1938 | Thomas | 131/175 |
| 2,323,856 | 7/1943 | Tillman | 131/175 |
| 2,398,695 | 4/1946 | Cloutier | 131/175 |
| 2,564,799 | 8/1951 | Anderson et al. | 131/215.3 |
| 2,580,523 | 1/1952 | Crone | 131/175 X |
| 2,620,804 | 12/1952 | McMahon | 131/175 |
| 2,644,463 | 7/1953 | Wheelock | 131/175 |
| 3,612,068 | 10/1971 | Higbee | 131/175 |
| 3,695,275 | 10/1972 | Hayward | 131/271 |
| 4,083,374 | 4/1978 | Jacobsen | 131/215.3 |
| 4,570,646 | 2/1986 | Herron | 131/175 X |
| 4,807,646 | 2/1989 | Sahar | 131/175 |
| 4,922,931 | 5/1990 | Nare et al. | 131/215.1 X |
| 4,993,435 | 2/1991 | McCann | 131/215.1 X |
| 5,048,545 | 9/1991 | Takagi et al. | 131/175 X |
| 5,160,518 | 11/1992 | Vega | 131/215.1 X |

*Primary Examiner*—Jennifer Bahr

*Attorney, Agent, or Firm*—Charles F. Meroni, Jr.

[57] ABSTRACT

A pocket sized smoke cleansing smoking device comprising an elongated tubular housing. The housing having a cigarette or tobacco receiving chamber. A mouthpiece at one end of the housing adjacent to the cigarette receiving chamber. A cigarette smoke outlet end of the device positioned at an opposite end of the housing. A filter receiving chamber at a downstream end of the device adjacent the cigarette outlet end. A smoke cleansing filter in the filter receiving chamber. A fan and motor assembly in the housing between the cigarette receiving chamber and the filter chamber for propelling smoke fumes from the cigarette receiving chamber axially through the filter to atmosphere. A smoke exhalation passageway on the device extending from the mouthpiece axially along the length of the housing and being in axial exhaled smoke receiving communication with the fan and motor assembly and with the filter for discharging exhaled filtered smoke to atmosphere. A finger operated two-way valve assembly positioned in adjacency to the mouthpiece and the cigarette chamber and the axially extending exhalation passageway enabling a smoker to draw cigarette or tobacco smoke from the cigarette chamber when the valve assembly is in one position and enabling exhaled tobacco smoke to be received through the mouthpiece for transport through the axially extending passageway through the filter for cleansing before reentry to atmosphere through the outlet end of the device.

15 Claims, 3 Drawing Sheets

CIGARETTE SMOKE CLEANSING SMOKING DEVICE

BACKGROUND OF THE INVENTION

Field of the Invention

My invention is particularly related to a cigarette or tobacco smoke cleansing smoking device which in the illustrated embodiment comprises a holder for the cigarette. The invention more particularly relates to a tobacco smoke cleansing pocket size smoking device where the user can smoke a cigarette or similar tobacco article in such a way that smoke can not readily escape from the smoking device unless the smoke has been cleansed by a smoke filter carried on the smoking device. In addition, and according to my invention, my pocket sized smoking device also is uniquely constructed so that inhaled smoke can be exhaled back through a mouthpiece disposed at one end of the smoking device so that the exhaled smoke can then also be cleansed by the filtering device carried in an opposite end of the smoking device. Thus, the smoking device has a two way function in that a single mouthpiece can be used on the smoking device to inhale smoke and then to receive exhaled smoke without transmitting unfiltered tobacco smoke to the atmosphere surrounding the smoker or others in the area of the smoker without first having been cleansed by the smoke filter.

Heretofore, various embodiments of a smoking device have been proposed and attention is directed to the following patents:

| Inventor: | Title: | U.S. Pat. No. |
|---|---|---|
| L. Ribera | Cigarette Holder | 1,896,015 |
| O. H. Martin | Cigarette or Cigar Holder | 2,073,596 |
| C. Blasutti | Ultrasonic Cigarette Holder or Pipe System | 4,131,119 |
| W. Pearlman | Automatic Smoking Device | 4,164,230 |
| A. C. Jackson | Combination Cigarette Holder and Cigarette Smoke Catcher | 4,369,798 |
| Bonanno et al. | Cigarette Holder | 4,637,407 |
| L. G. Valdez | Cigar or Cigarette Holder | 4,685,477 |
| F. E. Wallace | Smoke Eliminator For Cigarette Smokers | 4,790,332 |

It is not believed that any of the above patents relate to my invention and therefore further discussions of them is not believed to be necessary.

With respect to prior art U.S. Pat. No. 4,637,407 there are several primary points of difference that exist between my device and the patented device. In this respect, one important difference concerns the fact that the patented device makes no provision for having a by-pass valve and for utilizing the cigarette casing and its filtering system for the purpose of cleansing exhausted smoke. With the patented device, I contemplate using the fan and the filter as a means to move cigarette fumes out of the cigarette casing but there is no provision for blowing exhaled smoke into the filter tip end 18 and then to cause the smoke to be filtered in the way developed by the present applicant. Certainly there is no provision for the use of a by-pass valve to enable exhaled smoke to be blown longitudinally the length of the cigarette casing through the motor chamber and out through the filter end of the casing. With my device, I can use his motor and fan as a device to increase the velocity of the exhaled smoke to force it through the filter.

Another difference between my tobacco smoking device and the prior art device shown in the 407' patent concerns the way in which the cigarette or tobacco can be lit. There is provided a lighter hole in the door so that the cigarette can be lit when the door is closed and after the cigarette has been placed in the cigarette casing as shown in FIG. 1. With the patented device, it appears that the smoker must light his cigarette before he places it into the filtering device. The patentee has not clearly stated in this patent how this step can be accomplished. It appears that it would be necessary to remove an end of the cigarette casing to light the cigarette and thereafter the end of the casing is placed back onto the main part of the casing which carries the lit cigarette. It should also be noted that the 407' patent shows a so-called "huge smoking device" rather than a pen or pencil size smoking device as the present application has invented.

As will be described in greater detail hereinafter, my unique tobacco smoke cleansing pocket size smoking device is adapted for use with various types of members such as cigarettes, small cigars and the like. My pocket sized smoke cleansing smoking device has a two-way valve and a single filter tip in communication upstream with the valve so that a smoker can draw smoke from a burning smoking article such as a cigarette into the smokers mouth when the valve is in one position, then the smoker can exhale the smoke to cause the smoke to re-enter the mouthpiece and pass through a filter at an opposite end of the smoking device so that the exhaled smoke can be cleansed by the filter before it is discharged to atmosphere. My device further contemplates the use of a motor and a fan to draw fumes from the burning area of the tobacco to cause the fumes to flow to an opposite end of the smoking device where a filter is located so that the same filter can also be used to cleanse smoke being emitted by the burning tobacco. One of the main purposes of my invention is to permit a smoker to smoke tobacco without causing the fumes emitted from the burning tobacco to be circulated in the surrounding air without first having been cleansed by a smoke cleansing filter.

SUMMARY OF THE INVENTION

According to important features of my invention, I have provided a cigarette smoke cleansing pocket sized smoking device comprising an elongated tubular housing. The housing having a cigarette receiving chamber. A mouthpiece at one end of the housing adjacent to the cigarette receiving chamber. A cigarette smoke outlet end of the device positioned at an opposite end of the housing. A filter receiving chamber at a downstream end of the device adjacent the cigarette outlet end. A smoke filter in the filter receiving chamber. A fan and motor assembly in the housing between the cigarette receiving chamber and the filter chamber for propelling smoke fumes from the cigarette receiving chamber axially through the filter to atmosphere. A smoke exhalation passageway on the device extending from the mouthpiece axially along the length of the housing and being in axial exhaled smoke receiving communication with the fan and motor assembly and with the filter for discharging exhaled filtered smoke to atmosphere. A finger operated two-way valve assembly positioned in adjacency to the mouthpiece and the cigarette chamber and the axially extending exhalation passageway enabling a smoker to draw cigarette smoke from the cigarette chamber when the valve assembly is in one position and enabling exhaled smoke to be received through the mouthpiece for transport through the axially extending passageway through the filter for cleansing before reentry to atmosphere through the outlet end of the device.

Yet other features of my invention relate to the cigarette receiving chamber having a door that is pivotal in a direction radially away from the cigarette receiving chamber for opening same, the chamber having an ash receiving screen, the ash deposited on the ash receiving screen being dischargeable through a door opening when the door is pivoted to an open position.

Further features of my invention relate to the door having a lighter hole for enabling a cigarette to be lit when contained in the cigarette receiving chamber when the door is in a closed position.

Other and still further features of my invention relate to the fan and motor assembly having an on-off switch mounted on the device and being exteriorally accessible on the housing enabling a smoker to actuate the switch.

Still another feature of my invention relates to the cigarette receiving chamber being heat insulated to maintain exterior surfaces of the device in a cool condition to avoid flesh burns for a smoker when holding the device.

Still other important features concern my smoking device where the housing has two housing sections, thread means between the two housing sections enabling the two sections to be alternatively secured in co-axial aligned assembly or disengaged for servicing of the fan and motor assembly.

Yet another and still further feature of my invention relates to the ash receiving screen being removably assembled in the housing and with the screen being liftable out of the housing for discharge of ash contents and for cleansing of the ash receiving screen.

Yet another feature of my invention relates to the cigarette receiving chamber being in axial air flow communication with an outlet end of the device enabling air to be drawn through the outlet end into the cigarette receiving chamber when a smoker inhales air and smoke through the mouthpiece when the two-way valve adjusted to an inhale position.

An important feature of my invention relates to the two-way valve being adjustable to enable smoke in a smoker's mouth to be exhaled back into the cigarette smoke cleansing pocket sized device through the mouthpiece for filtration through the filter before being discharged through the outlet end to the atmosphere.

DESCRIPTION OF THE PREFERRED EMBODIMENT

Figure 2:
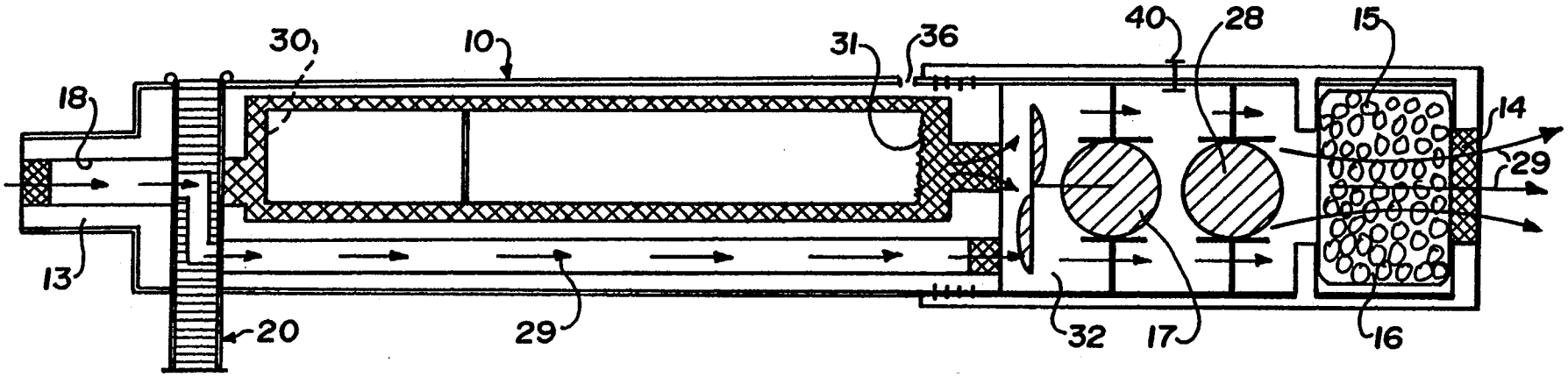
FIG. 2 is a diagrammatically illustrated cross-sectional view of the device shown in FIG. 1 with loading doors closed, and a two way bypass valve shown in an exhaling position.
Figure 3:
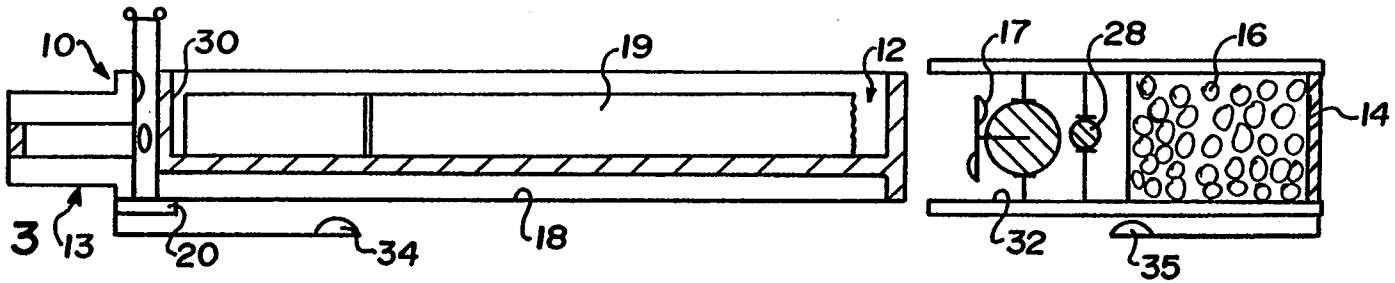
FIG. 3 is an exploded cross-sectional view of FIG. 1 with certain parts missing, the pipe bypass valve being up for use in an inhaling mode enabling smoke to be drawn through the mouthpiece to bring tobacco smoke to the mouth of the user, the sections of the housing being shown separated to enable a user to gain access to the compartment for providing service to the fan and motor assembly.

According to important features of my invention I have provided a pocket-sized tobacco smoke cleansing smoking device 10 which comprises an elongated tubular housing 11. The housing has a tobacco receiving chamber 12. A mouthpiece 13 is positioned at one end of the housing 11 adjacent to the tobacco receiving chamber 12. A tobacco smoke outlet end 14 is provided at an opposite end of the housing 11. The filter receiving chamber 15 is located at a downstream end of the device 10 adjacent the outlet end 14. A tobacco smoke filter 16 of a conventional construction is provided. This filter 16 is located in the filter receiving chamber 12 immediately adjacent to the outlet end 14. A fan and motor assembly 17 is also located in the housing 11 between the tobacco receiving chamber 12 and the filter chamber 15 for propelling smoke fumes from the tobacco receiving chamber 12 axially through the filter and through the outlet end 14 to atmosphere. An axially extending tobacco smoke exhalation passageway 18 is provided on the device which passageway extends from the mouthpiece 13 axially along the length of the housing 11 in a parallel relationship with the tobacco receiving chamber so that smoke being exhaled can be transported and controlled and cause to flow through the tobacco smoke exhalation passageway that extends from the mouthpiece to the area where the fan and motor assembly 17 is located and then past the fan and motor assembly through the filter 16 to atmosphere. A finger operated two-way valve assembly 20 is positioned between the mouthpiece 13 and the tobacco receiving chamber 12 and the axially extending smoke exhalation passageway 18 enabling a smoker to draw tobacco smoke from a lit cigarette 19 from the tobacco receiving chamber when the valve assembly 20 is in one position, as shown in FIG. 2, and enabling exhaled tobacco smoke to be received through the mouthpiece for transport through the axially extending passageway 18 through the tobacco smoke filter for cleansing the tobacco smoke before re-entry to atmosphere through an outlet end of the device when the valve assembly 20 is in a second position.

Attached are six Figures which illustrate my pocket sized cigarette smoking device 10 with a filter 16 for filtering smoke in the device and exhaled smoke blown back through the mouthpiece into the device 10.

In this connection, an ash retainer screen 21 of a cup shaped construction is provided. A door 22 can be moved from a closed position to an opened position on a hinge 23 securing the door to the housing 11 shown in FIG. 4 the ashes will not readily fall out of the device. The door 22 is preferably comprised of a see through transparent material such as a clear plastic so that the interior of the cigarette receiving chamber 12 can be observed.

Any accumulated ashes and cigarette butts can be removed from the main cigarette housing 11 by opening the long screen door 22 that overlies the cigarette 19 located in the tobacco or cigarette chamber 12 and then tapping the assemblage. The casing or housing 11 is then tapped in such a way that the ashes can fall out of the open door 22 as well as the cigarette butt that is to be discarded.

Figure 1:
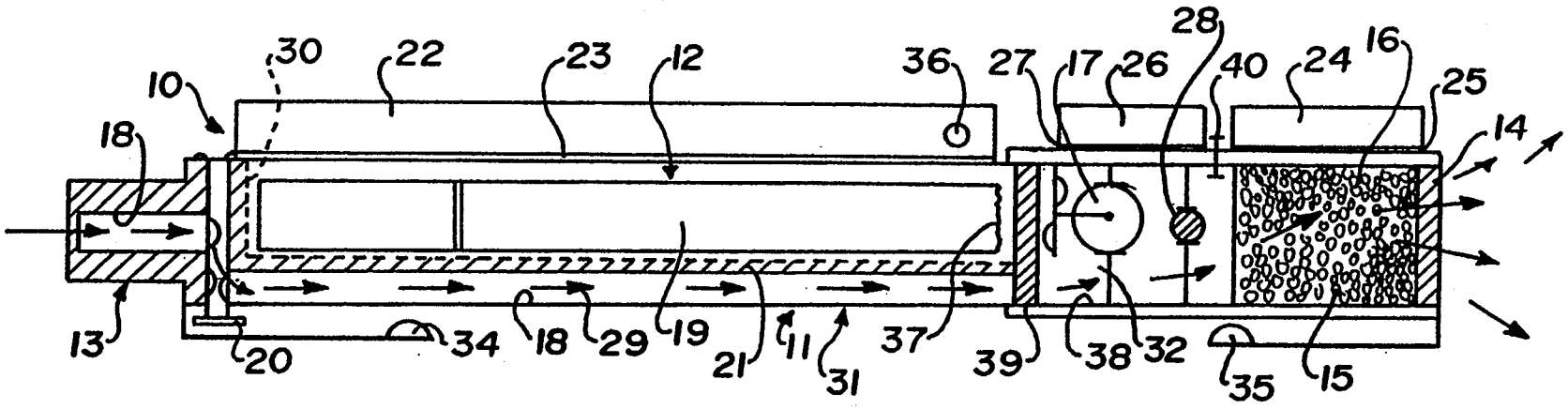
FIG. 1 is a cross-sectional view of my pocket-sized tobacco smoke cleansing smoking device which illustrates diagrammatically the construction in operation thereof.

In order to service the filter area to install a new filter and/or to replace the old filter 16, a filter door 24 is provided as shown in FIG. 1. This door 24 can be opened and closed on its hinge 25 to accommodate the replacement of the filter 16. A middle door 26 can also be opened on its hinge 27 for the purpose of servicing the motor and fan assembly 17 to clean the motor and to replace its battery 28 when required.

It will further be noted that the dished ash retainer screen 21 is closed at its opposite ends in adjacency to the point where exhale arrows 29 appear in FIG. 1 and also in adjacency to the fan and battery. By providing this screen door 22, the ashes will be confined. Thus, the battery and motor and fan area will be relatively free of ashes. It should further be appreciated that the ashes and butt will fall free of the cigarette casing when the long screen door 22 is in an opened position. The screen is cup shaped and has an open end or side 30 immediately under the long screen door 22 so that when the long screen door 22 is opened, the cigarette casing can be turned in such a way that the ash and butt can fall freely from the ash retainer screen 21 utilizing gravity to discharge the contents from the cigarette casing or housing 11.

It is contemplated that main cigarette housing section 31 has a length of about 5 inches. Then smaller housing chambers or sections 15 and 32 for the motor and fan and for the filter will have a length of roughly 2.⅛ inches. Thus, the device 10 has a length of about 5 inches that is roughly the same as a pocket pen or pencil which is conveniently sized for storage in a breast pocket of a person's shirt or coat.

Figure 4:
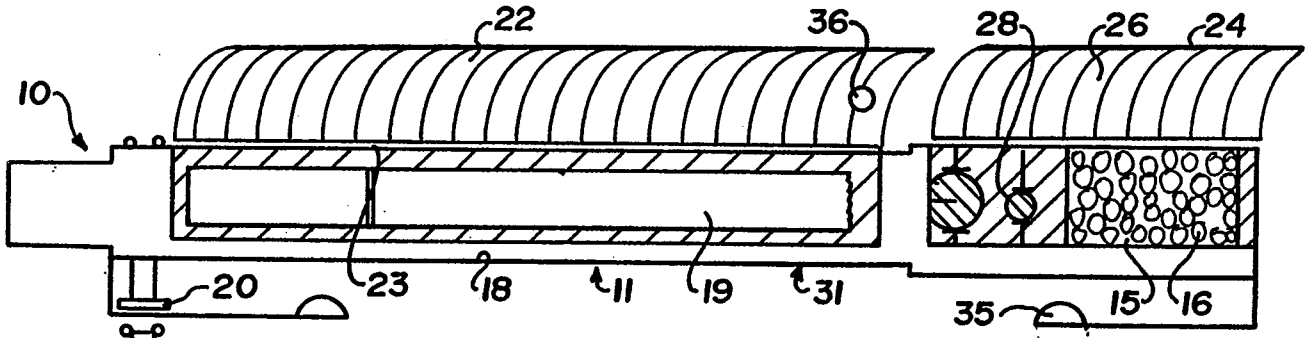
FIG. 4 is a diagrammatic view showing the various doors in an open position for servicing the pocket sized tobacco smoke cleansing smoking device.

FIG. 4 also shows how clips 34 and 35 can be provided at opposite ends of the device so that the clips can be used to lock the device in a breast pocket of a person or coat pocket in the same way that a fountain pen or pencil is stored.

In order to assist in igniting the smoking tobacco or cigarette 19 in the chamber 12, the door 22 is provided with a lighter hole 36 disposed at a down stream end of the chamber 12 in the close proximity to an end of the cigarette to be lit, as indicated at 37.

The fan and motor assembly 17 is located in a fan and motor chamber 32 in a fan and motor housing section 38 closed by the door 26.

Figure 5:
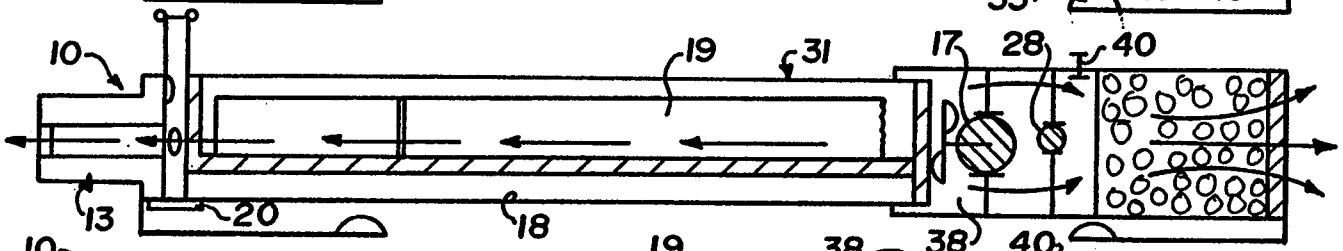
FIG. 5 shows the tobacco smoke cleansing smoking device with the valve in an inhale mode to draw smoke from the tobacco burning chamber into the mouth of the user.
Figure 6:
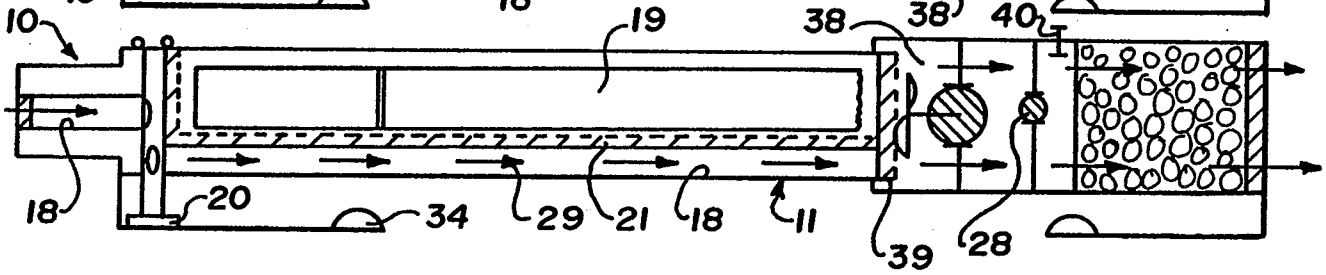
FIG. 6 is a diagrammatic view illustrating the two way valve in a position enabling the smoker to exhale smoke into the device to filter the exhaled smoke.

Screw threads and grooves 39 are provided to enable the housing 11 to be separated at the area of the threads for servicing of the fan and motor assembly 17 in the chamber 38 or to replace battery 40. The assembly 17 is coupled to the battery 28 in a conventional manner and an ON-OFF switch 40 (FIG. 5) is provided to operate the fan and motor assembly 17. The casing itself is manufactured or located with a heat resistant material or coating of a suitable type to enable it to be held by a human hand without discomfort from heat generated by the lit cigarette 19.

While the preferred form of the invention has been specifically illustrated and described herein, it will be apparent to those skilled in the art that modifications and improvements may be made to the form herein specifically disclosed. Accordingly, the present invention is not to be limited to the form herein specifically disclosed or in any other way inconsistent with the progress in the art promoted by this invention.

I claim:

1. In a cigarette smoke cleansing pocket sized smoking device comprising an elongated tubular housing, the housing having a cigarette receiving chamber, a mouthpiece at one end of the housing adjacent to said cigarette receiving chamber, a cigarette smoke outlet end of the device positioned at an opposite end of the housing, a filter receiving chamber is at a downstream end of said device adjacent said cigarette smoke outlet end, a smoke filter in said filter receiving chamber, a fan and motor assembly in said housing between said cigarette receiving chamber and filter receiving chamber for propelling smoke fumes from said cigarette receiving chamber axially through said smoke filter to atmosphere, a smoke exhalation passageway on the device in a parallel relationship with said cigarette receiving chamber and extending from said mouthpiece axially along the length of said housing and being in axial exhaled smoke receiving communication with said fan and motor assembly and with said smoke filter for discharging exhaled filtered smoke to atmosphere, and a finger operated two-way valve assembly positioned in adjacency to said mouthpiece and said cigarette receiving chamber and said axially extending smoke exhalation passageway, said valve assembly having one position connecting said mouthpiece to said cigarette receiving chamber for enabling a smoker to draw cigarette smoke from said cigarette receiving chamber and a second position connecting said mouthpiece to said smoke exhalation passageway for enabling exhaled smoke to be received through the mouthpiece for transport through said axially extending smoke exhalation passageway through said smoke filter for cleansing before reentry to atmosphere through said cigarette smoke outlet end of the device.

2. The cigarette smoke cleansing pocket sized smoking device of claim 1 wherein the cigarette receiving chamber has a door that is pivotally a direction radially away from the cigarette receiving chamber for opening same, the chamber having an ash receiving screen, the ash deposited on the ash receiving screen being discharge able through a door opening when the door is pivoted to an open position.

3. The cigarette smoke cleansing pocket sized smoking device of claim 2 wherein the door has a lighter hole for enabling a cigarette to be lit when contained in the cigarette receiving chamber when the door is in a closed position.

4. The cigarette smoke cleansing pocket sized smoking device of claim 1 wherein the fan and motor assembly has an on-off switch mounted on the device and being exteriorally accessible on said housing enabling a smoker to actuate the switch.

5. The cigarette smoke cleansing pocket sized smoking device of claim 1 wherein the cigarette receiving chamber is heat insulated to maintain exterior surfaces of the device in a cool condition to avoid flesh burns for a smoker when holding the device.

6. The cigarette smoke cleansing pocket sized cigarette smoking device of claim 1 wherein the housing has two housing sections, thread means between the two housing sections enabling the two sections to be alteratively secured in co-axial aligned assembly or disengaged for servicing of said fan and motor assembly.

7. The cigarette smoke cleansing pocket sized smoking device of claim 2 wherein the ash receiving screen is removably assembled in said housing and is liftable out of the housing for discharge of ash contents and for cleansing of the ash receiving screen.

8. In a pocket sized tobacco smoke cleansing smoking device comprising an elongated tubular housing, the housing having a tobacco smoking article receiving chamber, a mouthpiece at one end of the housing adjacent to said tobacco smoking article receiving chamber, a tobacco smoke outlet end of the device positioned at an opposite end of the housing, a filter receiving chamber is at a downstream end of said device adjacent said tobacco smoke outlet end, a tobacco smoke cleansing filter in said filter receiving chamber, a fan and motor assembly in said housing between said tobacco smoking article receiving chamber and filter receiving chamber for propelling smoke fumes from said tobacco smoking article receiving chamber axially through said filter to atmosphere, a tobacco smoke exhalation passageway on the device in a parallel relationship with said tobacco smoking article receiving chamber and extending from said mouthpiece axially along the length of said housing and being in axial exhaled tobacco smoke receiving communication with said fan and motor assembly and with said filter for discharging exhaled filtered tobacco smoke to atmosphere, and a finger operated two-way valve assembly positioned in adjacency to said mouthpiece and said tobacco smoking article receiving chamber and said axially extending tobacco smoke exhalation passageway, said valve assembly having one position connecting said mouthpiece to said smoking article receiving chamber for enabling a smoker to draw tobacco smoke from said tobacco smoking article receiving chamber and a second position connecting said mouthpiece to said tobacco smoke exhalation passageway for enabling exhaled tobacco smoke to be received through the mouthpiece for transport through said axially extending tobacco smoke exhalation passageway through said filter for cleansing before reentry to atmosphere through said tobacco smoke outlet end of the device.

9. The pocket sized tobacco smoke cleansing smoking device of claim 8 wherein the tobacco receiving chamber has a door that is pivotal in a direction radially away from the tobacco receiving chamber for opening same, the chamber having a tobacco ash receiving screen, the ash deposited on the ash receiving screen being dischargeable through a door opening when the door is pivoted to an open position.

10. The pocket sized tobacco smoke cleansing smoking device of claim 9 wherein the door has a lighter hole for enabling a cigarette to be lit when contained in the cigarette receiving chamber when the door is in a closed position.

11. The pocket sized tobacco smoke cleansing smoking device of claim 8 wherein the fan and motor assembly has an on-off switch mounted on the device and being exteriorally accessible on said housing enabling a smoker to actuate the switch.

12. The pocket sized tobacco smoke cleansing smoking device of claim 8 wherein the cigarette receiving chamber is heat insulated to maintain exterior surfaces of the device in a cool condition to avoid flesh burns for a smoker when holding the device.

13. The pocket sized tobacco smoke cleansing smoking device of claim 8 wherein the housing has two housing sections, thread means between the two housing sections enabling the two sections to be alternatively secured in co-axial aligned assembly and then disengaged for servicing of said fan and motor assembly.

14. The pocket sized tobacco smoke cleansing smoking device of claim 9 wherein the ash receiving screen is removably assembled in said housing and is liftable out of the housing for discharge of ash contents and for cleansing of the ash receiving screen.

15. In a pocket sized tobacco smoke cleansing smoking device comprising an elongated tubular housing, the housing having a tobacco receiving chamber, a mouthpiece at one end of the housing adjacent to said tobacco receiving chamber, a tobacco smoke outlet end of the device positioned at an opposite end of the housing, a filter receiving chamber is at a downstream end of said device adjacent said tobacco smoke outlet end, a tobacco smoke filter in said filter receiving chamber immediately adjacent to said tobacco smoke outlet end, a fan and motor assembly in said housing between said tobacco receiving chamber and filter receiving chamber for propelling smoke fumes from said tobacco receiving chamber axially through said filter to atmosphere, a tobacco smoke exhalation passageway on the device in a parallel relationship with said tobacco receiving chamber and extending from said mouthpiece axially along the length of said housing and being in axial exhaled smoke receiving communications with said fan and motor assembly and with said filter for discharging exhaled filtered smoke to atmosphere, and a finger operated two-way valve assembly positioned between said mouthpiece and said tobacco receiving chamber and said axially extending tobacco smoke exhalation passageway, said valve assembly having one position connecting said mouthpiece to said tobacco receiving chamber for enabling exhaled tobacco smoke to be received through the mouthpiece for transport through said axially extending tobacco smoke exhalation passageway through said tobacco smoke filter for cleansing the tobacco smoke before reentry to atmosphere through said tobacco smoke outlet end of the device.

* * * * *